United States Patent [19]

Treiber et al.

[11] 4,287,407

[45] Sep. 1, 1981

[54] TANK FLUSHING DELAY ARRANGEMENT FOR A STEAM GENERATOR

[75] Inventors: Fritz F. Treiber, Centerville; Dallas A. Margraf, Spring Valley, both of Ohio

[73] Assignee: Hobart Corporation, Troy, Ohio

[21] Appl. No.: 934,532

[22] Filed: Aug. 17, 1978

[51] Int. Cl.[3] ..... H05B 1/02; F22B 1/28; F22B 37/50

[52] U.S. Cl. ..... 219/273; 122/379; 122/382; 122/396; 219/295; 219/327; 219/332; 219/333

[58] Field of Search ..... 219/332, 333, 271–276, 219/362, 401, 284–295, 327, 323, 324; 122/379, 381, 382, 388, 396; 126/20.1, 20.2, 20, 369.1–369.3, 369; 422/295–299

[56] References Cited

U.S. PATENT DOCUMENTS

| | | | |
|---|---|---|---|
| 2,790,890 | 4/1957 | Kasuga | 219/287 |
| 3,025,381 | 3/1962 | Pickering | 219/272 X |
| 3,077,530 | 2/1963 | Chase et al. | 219/401 |
| 3,082,312 | 3/1963 | Shaw | 219/272 X |
| 3,291,964 | 12/1966 | Williams | 122/382 X |
| 3,660,635 | 5/1972 | Liebert | 219/273 |
| 3,761,679 | 9/1973 | Dall | 219/272 X |
| 4,107,511 | 8/1978 | Shulz et al. | 219/273 X |

*Primary Examiner*—A. Bartis

*Attorney, Agent, or Firm*—Biebel, French & Nauman

[57] ABSTRACT

A steam generator includes a tank with a water inlet valve, a steam outlet, an electric immersion heater in said tank, and a normally closed drain valve. A water level control, connected to the inlet valve and the heater, is arranged to apply power to the heater only when it is immersed, and to admit make up water into the tank as steam is used. A drain valve control is connected to said drain valve and operates to open the drain valve to flush the tank only upon starting the generator after completion of a generator cooling period sufficient to condense residual steam in the tank which follows shut down of the generator. The completion of such a cooling period is sensed by either a pressure sensitive or a temperature sensitive switch which responds to conditions in the generator. The switch is connected to the drain valve control to prevent opening of that valve should the generator not be cooled to ambient temperature.

7 Claims, 2 Drawing Figures

TANK FLUSHING DELAY ARRANGEMENT FOR A STEAM GENERATOR

BACKGROUND OF THE INVENTION

This invention relates to steam generators, particularly small steam generators adapted to produce clean saturated steam to be used in steam cooking, sterilizing apparatus, heat exchangers, and where other needs for clean steam are presented. Typical devices of this type are disclosed in U.S. Pat. Nos. 3,083,288 and 3,114,028, both assigned to the assignee of this application. These generators operate with a supply of fresh potable water, and are used in an open cycle type of operation, where the product steam is piped into a cooker, and after use the steam is exhausted to a drain, usually in condensed form. Thus, there is no condensation of the used steam and recirculation of the condensate to the boiler/generator, as is typically done in larger steam powered generating systems.

Because of this type of duty, the steam generator is supplied with fresh water, and as the demand for steam from the unit continues, an automatic water level control system provides replenishment of water in the boiler tank. It is impractical to treat the water, beyond normal treatment from the potable water supply used to connect to the water inlet of the boiler tank. Thus, in many instances the water supply to such steam generators is relatively hard water, and mineral deposits, especially caked lime, form on the interior of the steam generator tank, particularly during periods of shutdown, and present a continuing maintenance and operation problem.

For example, a typical steam generator of this type is started and used during meal times in a restaurant. It may or may not be shut down between the hours when steam cooking is not required, but in any event the generator will be shut down overnight. In the past, a typical device has been provided with a simple shutoff/-blow down valve arrangement, wherein a single control when turned to the off position terminates power to the steam generator and at the same time opens a drain valve. Residual steam pressure was used to "blow down" the generator tank, causing any remaining water to be forced through the drain, with the interior of the tank being surface wet but empty, and open to atmosphere through the drain such that it dried out eventually. Also, many such steam generating units utilize electrical heating elements of the immersion type which project into the tank and are intended to be immersed to the water during operation. Exposure of these elements to air or the steam within the tank, or any other fault which causes the elements to be immersed in caked lime instead of water, results quickly in hot spots being formed in the heating elements with resulting burnout.

Therefore, it has been discovered that blowing down of such steam generator tanks results in the formation of scale on the tank interior, and on the surfaces of the heating elements, at a rather rapid rate, and under conditions such that the scale builds up daily (or nightly) during the shutdown periods. It has been found that in geographic regions where particularly hard water is available from the normal supply, the hardened scale on the tank interiors must be removed regularly, and this entails disassembling the tank, by removing the pressure head, cleaning the scale from the tank interior and the elements, and reassembling. Since these units are subject to the standard boiler codes, the cleaning operations should be performed by qualified personnel, and the task is both difficult and time consuming. When this cleaning operation must be performed once every several months, it becomes a burden to the user.

Furthermore, a typical installation arrangement in the past has been to connect the drain line from the steam generator to an open drain in the kitchen floor. These drains are commonly installed in commercial kitchens, because of the necessary hygenic clean up which is required by health codes. However, in many jurisdictions there is pending or protective legislation which forbids the venting of live steam into an open drain, where the steam might flow back into the kitchen area. Therefore, closed drains will be required by code in many places, even though this is not presently a strict requirement.

It has been known that the build-up of scale within such steam generators can be minimized if the tank is kept full, at least to a level immersing the heating elements, and closed to the atmosphere when the unit is shut down. Steam generators of this type have included provisions to retain water in the tank during overnight periods, or the like, and this in turn minimizes the formation of hardened scale, with the deposits within the tank building up more in the form of a mud or thick but somewhat fluid material. It is believed that provisions have been made to flush the tank upon starting, to assure that these thick but fluid deposits are regularly flushed from the tank. This provides that the deposits do not collect to the point where they interfere with operation of the generator. However, if the generator is started and stopped frequently, automatic flushing at each start is wasteful of water, and also of energy if the water is still hot. Furthermore, if the unit is flushed with cool fresh water while the heater is still hot, it is possible to damage the heater from thermal shock.

SUMMARY OF THE INVENTION

In accordance with the present invention build-up of scale in the steam generator tank is substantially reduced, almost to the point of being eliminated in many installations, by a type of control arrangement which also prevents the discharge of live steam into the drain as part of the shutdown operation. The drain valve for the tank is provided as a power-operated normally closed valve, such as a normally closed solenoid valve, and when the unit is turned off, the circuit to the drain valve remains open. Thus, after a normal term of operation, the tank contains at least the predetermined minimum amount of water therein, the heating elements are immersed in water, and with power off the unit cools down. This cooling period represents a predetermined interval, which while not precise, is determinable to the extent that after a certain time passes from shutdown, it can be expected the water remaining in the tank will have cooled approximately to ambient temperature. This water remaining in the tank tends to keep any minerals therein in solution, for example during an overnight shutdown.

When the operator turns on power to the unit the next morning, the drain valve and the power-operated water inlet valve are opened. The flow capacity of the drain valve exceeds that of the inlet valve, thus all the water which remained in the tank is drained away, carrying away particles which may be formed in the pool of water. This flushing sequence continues for a predetermined time, for example approximately three minutes, while fresh water is admitted to flush down the interior of the tank and the surface of the heating elements therein. Thereafter, the control circuit closes the drain valve, water collects in the tank, and when the water level reaches a predetermined minimum, at which the heating element is fully immersed, power is applied to the heating element. Water continues to enter the tank through the open inlet valve as heating continues, until such time as the water level reaches a maximum. At this point the water inlet valve is closed. Heating of the water continues to the vaporization point, steam is generated and collects in the upper portion of the tank, and a condition sensitive switch, for example a pressure sensitive switch, opens the circuit to the heating element when the operating pressure of the generator is reached. Typically this is at 13 psig.

The generator is then in full operation, and steam will be supplied on demand to the cooking unit attached to the steam outlet line from the tank. As steam usage continues, the water level will drop, and when it reaches a point part way between full and the aforementioned minimum water level, the control circuit will sense this drop in the water level and open the inlet valve to admit water until the water level again reaches the maximum, at which time the inlet valve is closed.

Usage of the generator continues in this fashion. Whenever the water level drops beyond the predetermined part way point, additional water is added up to the maximum level. Whenever there is no steam demand on the unit, it will build up to its maximum pressure, at which time the condition sensing switch will interrupt power to the heating elements. As steam is used, once the pressure drops below the condition sensing threshold, the heating elements again will be connected to power and steam generation will continue.

Upon shutdown, as mentioned previously, the drain valve remains closed, while the circuit to the water inlet valve is interrupted, and it too is closed. The amount of water then held in the tank will under ordinary circumstances be at least to the part way level where filling commences following steam usage.

A further condition sensitive switch, preferably a pressure sensitive switch which responds to low pressure, in the order of one-half to one psig, is connected in the supply circuit to the drain valve. This condition sensing switch assures that the drain valve cannot be energized for the cooling period, as previously discussed, since it will open the power circuit to the drain valve until the pressure in the tank has dropped to this low setting.

Therefore, if for any reason power is turned off to the generator, and is again turned on within the cooling period, the drain valve will remain closed. Since conditions in the tank are below the maximum setting, power will be applied to the heating elements and steam generation will commence with the water remaining in the tank. A time delay is provided in the drain valve circuit, and this time delay is used to control the aforementioned flushing term. When the unit is turned on within the cooling period, the time delay runs its term without any opening of the drain valve, since the low pressure switch is still open, thus under these conditions the flush sequence is eliminated from the control, and the unit quickly comes back to operation.

The primary object of the invention, therefore, is to provide a steam generator of the type described, and method of operating the generator, in which a substantial quantity of water is retained in the tank after the generator is turned off to maintain the heating elements immersed, whereby formation of hardened scale deposits within the tank is avoided, and to provide an automatic flushing sequence wherein this retained water is drained and the interior of the tank is flushed with clean water prior to commencement of the next operation of the generator, but only if the generator has been shut down in excess of a predetermined cooling period; to provide such a control for a steam generator wherein the tank is not blown down at the end of operation, but is allowed to cool causing any remaining steam therein to condense, and thus avoiding discharge of live steam at any time through the tank drain; and to provide such a control wherein the cooling period for the generator is determined either by sensing conditions in the tank at which steam is no longer steam, or by providing at least a minimum time interval at the end of shutdown, only after which the drain valve can be opened, for example by inserting a further time delay unit into the control power circuit for the drain valve.

Other objects and advantages of the present invention will be apparent from the following description, the accompanying drawings and the appended claims.

DESCRIPTION OF THE PREFERRED EMBODIMENT

Figure 1:
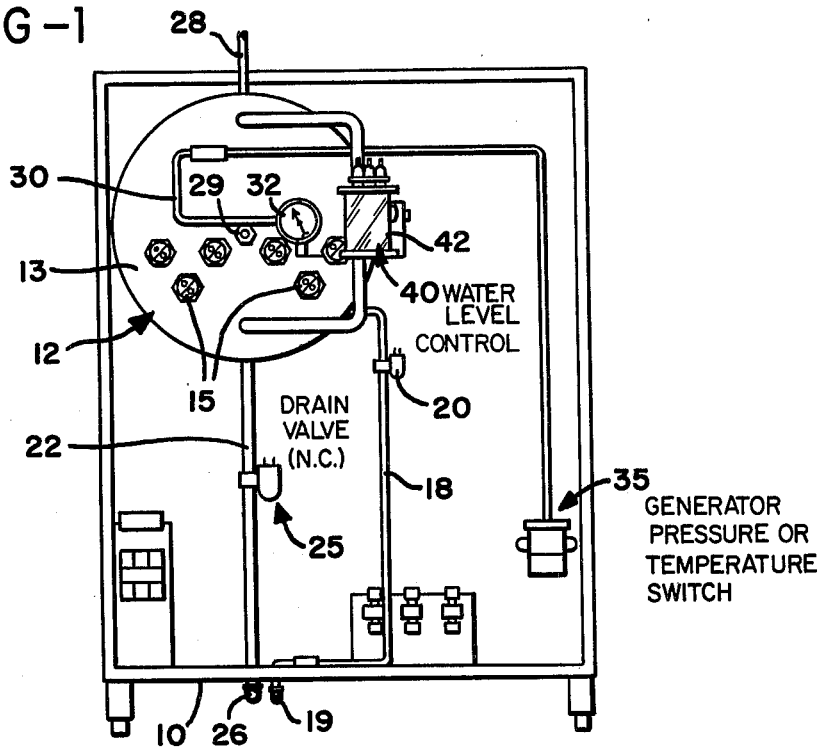
FIG. 1 is a somewhat schematic front view of a steam generator incorporating the invention, with the cover panel removed.

Referring to FIG. 1, a cabinet 10 is shown encasing a steam generator tank 12, which is a cylindrical body having a removable head 13, the surface of which is seen in FIG. 1, with the tank extending therebehind. The head mounts a plurality of heating elements 15 which extend into the lower half of the tank interior in conventional fashion. A water inlet line 18 extends from an external fitting 19 Which can be connected to a source of potable water, and the inlet line 18 includes a normally closed solenoid operated water inlet valve 20, from which the water line extends to the interior of the tank 12.

A drain line 22 extends from the bottom of the tank and incorporates a normally closed solenoid operated drain valve 25, from which the drain line extends to an external fitting 26 adapted for connection to a convenient drain at the point of installation.

The steam outlet line is shown at 28, extending to an inlet fitting (not shown) on a typical steam cooking unit such as shown in U.S. Pat. Nos. 3,992,984 and 3,951,131 or to a typical sterilizer. The cooker is provided with an inlet valve which controls the flow of steam from the generator tank to the cooker. The tank is also provided with an anode 29 to minimize electrolytic action on the metal of the tank and heating elements. A pressure tube 30 opens from the interior of the tank to a gage 32, and also extends to a pressure switch housing 35, these being the preferred type of condition sensing switch for the control. One switch, as later described in FIG. 2, senses the maximum desired pressure in the tank, and the other switch senses the minimum desired pressure indicating end of the cooling period. It should be understood, however, that since pressure and temperature conditions are interrelated in such generators, the condition sensing switches can be provided as temperature sensing devices.

Figure 2:
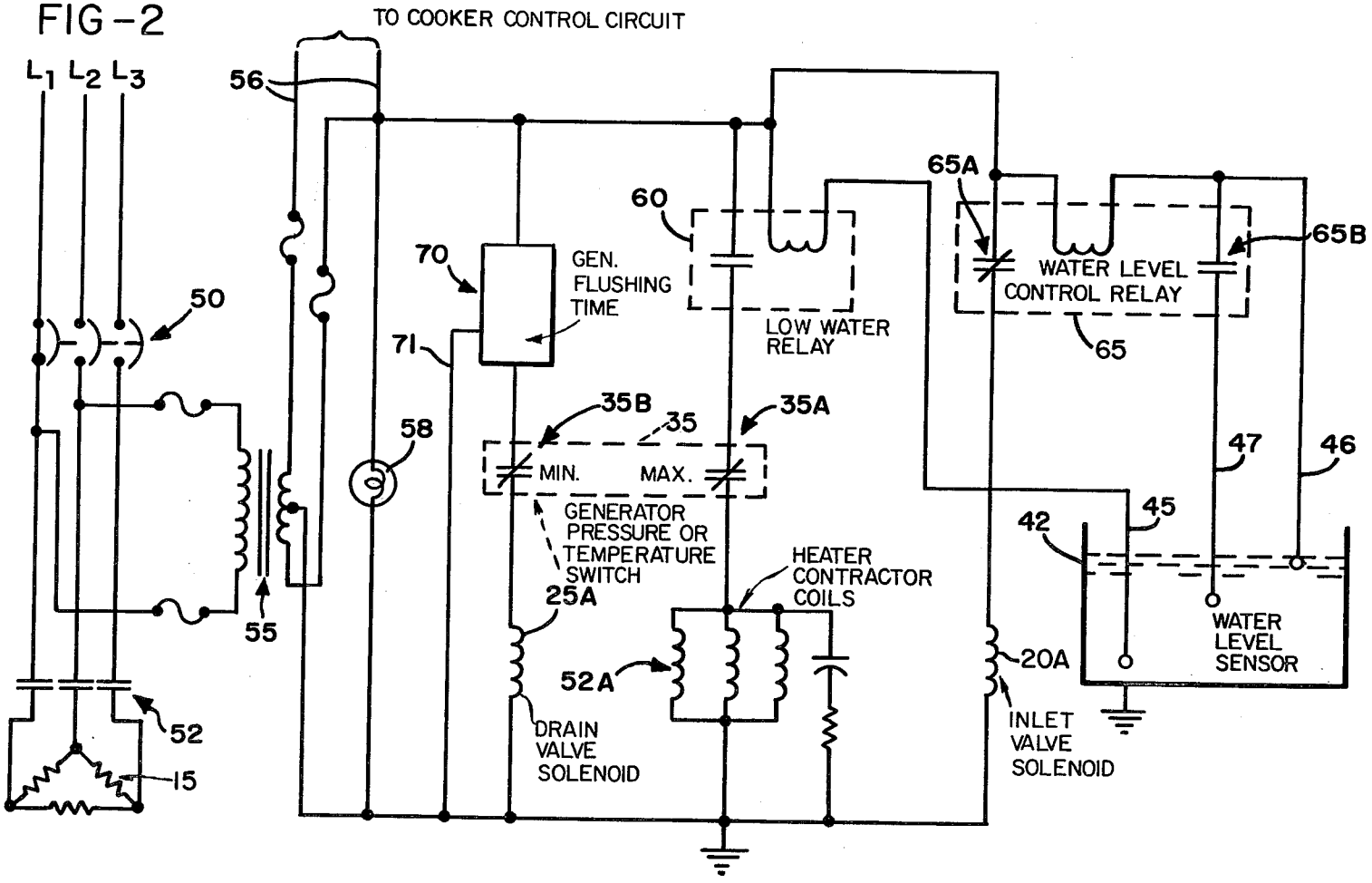
FIG. 2 is a circuit diagram illustrating the control circuit of the invention.

A water level control or sensor 40 is provided with three separate level sensing probes. These probes are surrounded by a housing which is either transparent, or has a transparent wall, being indicated generally at 42, and functioning also as a sight glass for the unit. Details of the water level control are shown in FIG. 2, where the low level probe 45 determines the minimum water level at which power can be supplied to the heating elements. The high level probe 46 determines the maximum water level within the tank, at which the water inlet valve will be closed, and the middle or intermediate probe 47 is used to determine the level at which the water inlet valve is reopened during usage of the generator.

Referring further to FIG. 2, the power supply is indicated by the lines L1, L2, and L3, representing a typical three phase electrical power supply. It should be understood, however, that single phase supply is also used. These power supply lines pass to the main circuit breaker 50 which also functions as the master manually actuated power supply switch for the generator. The power supply lines extend from the circuit breaker to the contactors 52 which control the application of power to the heating elements.

A control circuit supply transformer 55 has its primary winding connected to two of the supply lines, and its secondary winding provides power to the various control circuits through a center-tap arrangement as shown, with the power supply to the cooker for its timer and valves, preferably being connected across the transformer secondary at lines 56 to interlock the cooker function with the steam generator. These lines may be fused as shown, and a neon pilot light (or equivalent) shown at 58, is connected across the control circuit supply, being mounted in the cabinet 10 at a convenient location to indicate to the operator that the power is on.

The contactor coils are shown at 52A, being connected in a series control circuit with the maximum pressure sensing switch 35A and the normally open contacts of a low water control relay 60. The winding of relay 60 is connected in series with the low (minimum level) water probe 45, hence the water level must rise at least to the point of touching the low probe 45 before relay 60 is energized and its contacts closed. When this happens, assuming that there is no steam pressure in the unit, as during start-up, the pressure sensing switch 35A will be closed, and power to the contactor coils will in turn close the main contactors 52 to apply full power to the heating elements 15. Thus switch 35A and relay 60 along with probe 45 provide a means energizing the heater under their respective control.

With the water level thus at the minimum level and the solenoid 20A of the water inlet valve energized, control of the water level transfers to the operating relay 65. Its normally closed contacts 65A are in a series control circuit with the water valve solenoid winding, and thus the water inlet valve will be held open at this time. When the water level reaches the high or maximum level probe 46, power will be applied through the coil of the relay 65 and its normally closed contacts 65A will open, while its normally open contacts 65B will close. These contacts 65B are in the circuit of the intermediate probe 47.

Therefore, the opening of relay contacts 65A will de-energize the solenoid 20A for the water inlet valve and it will close. As steam is generated and used, the water level gradually will drop beyond the high probe, however the relay 65 will remain energized through the middle probe and the contacts 65B. When sufficient water is used to drop the level beyond the middle probe, relay 65 will be de-energized, the contacts will transfer to the original condition, and the water inlet valve will again open until the water level reaches the high probe 46.

The drain valve solenoid 25A is connected in a series circuit with the minimum condition sensing pressure switch 35B. This is the switch which opens during operation above one-half psig, and closes only when pressure in the tank has reduced to a low value, for example, one-half to one psig, providing a means maintaining the drain valve closed when steam is present in he tank. A further condition is imposed upon energization of the drain valve in that the series circuit also contains a generator flushing timer device 70 which has a normally open circuit connected in series with the pressure switch 35B and the drain valve solenoid 25A. Whenever power is applied at start-up, the flushing timer 70 is energized through line 71, and completes the circuit to the drain valve solenoid for a predetermined time, in the order of three minutes, e.g. the time of the desired flush sesquence, after which the timer 70 opens the circuit to the drain valve solenoid 25A, allowing drain valve 25 to close and the tank to begin filling with fresh water under control of the water level sensor. This provides the means opening both valves for a tank flushing sequence. However, it will be noted that this sequence occurs only if the pressure switch 35B is closed, and this in turn can occur only if the cooling period has elapsed, thereby providing a means to prevent opening of the drain valve during the cooling period. Switch 35B may comprise a temperature switch indicative of the presence of steam in the steam generator tank rather than a pressure switch.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention.

What is claimed is:

1. In a steam generator adapted for intermittent operation, a tank having a water inlet, a steam outlet, and a drain, a heater associated with said tank to heat water therein to the vaporization temperature, a power operated inlet valve controlling said water inlet, a power operated normally closed drain valve controlling said drain, a water level sensor connected to said tank, means for sensing the pressure of steam in said tank;

the improvement comprising a control circuit connected to said valves, said heater, said sensing means, and said water level sensor, said control circuit including means for opening said inlet valve in response to a low water level sensed by the water level sensor, means for opening said drain valve for a predetermined time period upon starting said generator to drain water from said tank and for automatically closing said drain valve after expiration of the predetermined period to initiate filling of said tank, said inlet valve being opened in response to a low water level sensed by the water level sensor during said perdetermined period to flush the tank with fresh water, means energizing said heater and inlet valve under control of said water level sensor and said pressure sensing means to maintain water level in said tank within predetermined limits as steam is generated and used, and delay means connected in circuit with said drain valve opening means to prevent opening of said drain valve by said drain valve opening means for a predetermined cooling period sufficient to condense residual steam in the tank after said generator has been turned off following a period of operation, whereby water is retained in said tank at a predetermined level when the generator is turned off and the tank is flushed upon starting only if the generator has been turned off and the predetermined cooling period has elapsed.

2. A steam generator as defined in claim 1, wherein said delay means is a condition responsive device sensing presence of steam in said tank.

3. A steam generator as defined in claim 2, wherein said condition responsive device is a pressure responsive normally closed switch arranged to open in response to any effective pressure in said tank above atmospheric pressure.

4. In a steam generator having a tank with a water inlet valve, a steam outlet, and a normally closed drain valve, a heater for said tank, a water level control for said inlet valve, said water level control arranged to maintain the water level in said tank between minimum and maximum levels, said water level control permitting power to be applied to said heater only when the water in said tank is above the minimum water level, and said water level control admitting make up water into said tank as steam is used from said outlet, the improvement comprising drain valve control means connected to said drain valve and operative to automatically open said drain valve for a predetermined flush period upon starting of said generator, and delay means cooperating with said drain valve control means to delay opening of said drain valve by said drain valve control means until the end of an elapsed cooling period sufficient to condense residual steam in said tank in the event of starting said generator promptly after shut down of said generator from a previous operation.

5. A steam generator as defined in claim 4, wherein said heater is an electric immersion heater.

6. In a steam generator having a tank, a water inlet including an inlet valve connected to said tank, a steam outlet from said tank, a drain from said tank including a normally closed drain valve, and a heater for producing steam from water in said tank;

the improvement comprising a control including means automatically opening said drain valve and said inlet valve upon starting said generator, means automatically closing said drain valve after a predetermined flushing period, means holding said inlet valve open until the water level in said tank reaches a predetermined level and continuing periodically to open said inlet valve to make up for lowering water level due to steam consumption, means energizing said heater in response to water reaching said predetermined level, and delay means inhibiting opening of said drain valve by said drain valve opening means until the end of an elapsed cooling period sufficient to condense any residual steam in the tank in the event that the generator is started shortly after shut down of the generator from a previous operation.

7. The method of operating a demand steam generator using a potable water supply, comprising heating potable water in a tank to its vaporization temperature and using the resulting steam for cooking or sterilizing, replenishing the water in the tank according to the demand for steam, upon shut down of the generator retaining a predetermined amount of water in the tank to keep minerals in suspension, automatically flushing retained water from the tank upon start up only if a predetermined cooling period sufficient to condense residual steam in the tank has elapsed following the last preceding shut down.

* * * * *